US006176554B1

(12) United States Patent
Huang

(10) Patent No.: US 6,176,554 B1
(45) Date of Patent: Jan. 23, 2001

(54) ROLLER SKATE WHEEL

(76) Inventor: Chuan-Hai Huang, No. 35-36, Hsia Keng Rd., Hsia Keng Village, Fan Lu Hsiang,Chia-I Hsien (TW)

( * ) Notice: Under 35 U.S.C. 154(b), the term of this patent shall be extended for 0 days.

(21) Appl. No.: 09/370,202

(22) Filed: Aug. 9, 1999

(51) Int. Cl.[7] ..... A63C 17/22
(52) U.S. Cl. ..... 301/5.7
(58) Field of Search ..... 301/5.3, 5.7, 64.2, 301/64.3, 64.7, 64.4; 152/323, 324, 396, 379.5, 384, 397, 398, 5, 7, 313, 312, 311; 280/11.19, 11.22, 11.23, 11.24, 11.25

(56) References Cited

U.S. PATENT DOCUMENTS

| | | | | |
|---|---|---|---|---|
| 2,588,097 | * | 3/1952 | Eiras | 152/312 |
| 2,701,740 | * | 2/1955 | Norman | 301/5.7 |
| 5,308,152 | * | 5/1994 | Ho | 280/11.23 |
| 5,478,140 | * | 12/1995 | Racosky | 301/5.7 |
| 5,630,891 | * | 5/1997 | Peterson et al. | 152/327 |
| 5,632,829 | * | 5/1997 | Peterson et al. | 152/329 |
| 5,641,365 | * | 6/1997 | Peterson et al. | 152/325 |
| 5,667,280 | * | 9/1997 | Hansen | 301/5.3 |
| 5,733,015 | * | 3/1998 | Demarest et al. | 301/5.3 |
| 5,810,450 | * | 9/1998 | Tsu et al. | 301/5.3 |
| 5,860,707 | * | 1/1999 | Keleny | 301/64.7 |
| 5,873,600 | * | 2/1999 | Conway | 301/5.3 |
| 5,897,170 | * | 4/1999 | Keleny | 301/5.3 |
| 5,922,151 | * | 7/1999 | Piper et al. | 301/5.3 |

FOREIGN PATENT DOCUMENTS

| | | | | |
|---|---|---|---|---|
| 2369855 | * | 7/1978 | (FR) | 301/5.3 |
| 360745 | * | 1/1931 | (GB) | 301/5.3 |

* cited by examiner

*Primary Examiner*—S. Joseph Morano
*Assistant Examiner*—Long Bao Nguyen
(74) *Attorney, Agent, or Firm*—Rosenberg, Klein & Lee

(57) ABSTRACT

A roller skate wheel includes an outer wheel body defining a receiving space and having an inner wall formed with a first annular flange and a second annular flange spaced from each other, an inner tire received in the receiving space, a first wheel cap secured to the first annular flange, a first bearing received in a first opening defined in the first wheel cap, a second wheel cap secured to the second annular flange and securely coupled with the first wheel cap, and a second bearing received in a second opening defined in the second wheel cap.

6 Claims, 7 Drawing Sheets

ROLLER SKATE WHEEL

BACKGROUND OF THE INVENTION

1. Field of the Invention

The present invention relates to a roller skate wheel.

2. Description of the Related Prior Art

A conventional roller skate wheel 1 shown in FIG. 1 is integrally formed by a plastic material which is rigid without elasticity so that the roller skate wheel 1 cannot absorb an external impact exerted thereon when the roller skate wheel 1 hits the ground, thus easily injuring the exerciser during exercising.

SUMMARY OF THE INVENTION

The primary objective of the present invention is to provide a roller skate wheel comprising an outer wheel body defining a receiving space and having an inner wall formed with a first annular flange and a second annular flange spaced from each other, an inner tire received in the receiving space, a first wheel cap secured to the first annular flange, a first bearing received in a first opening defined in the first wheel cap, a second wheel cap secured to the second annular flange and securely coupled with the first wheel cap, and a second bearing received in a second opening defined in the second wheel cap.

Further objectives and advantages of the present invention will become apparent after a complete reading of the detailed description with reference to the accompanying drawings.

BRIEF DESCRIPTION OF THE DRAWINGS

1

DETAILED DESCRIPTION OF THE PREFERRED EMBODIMENTS

Figure 1:
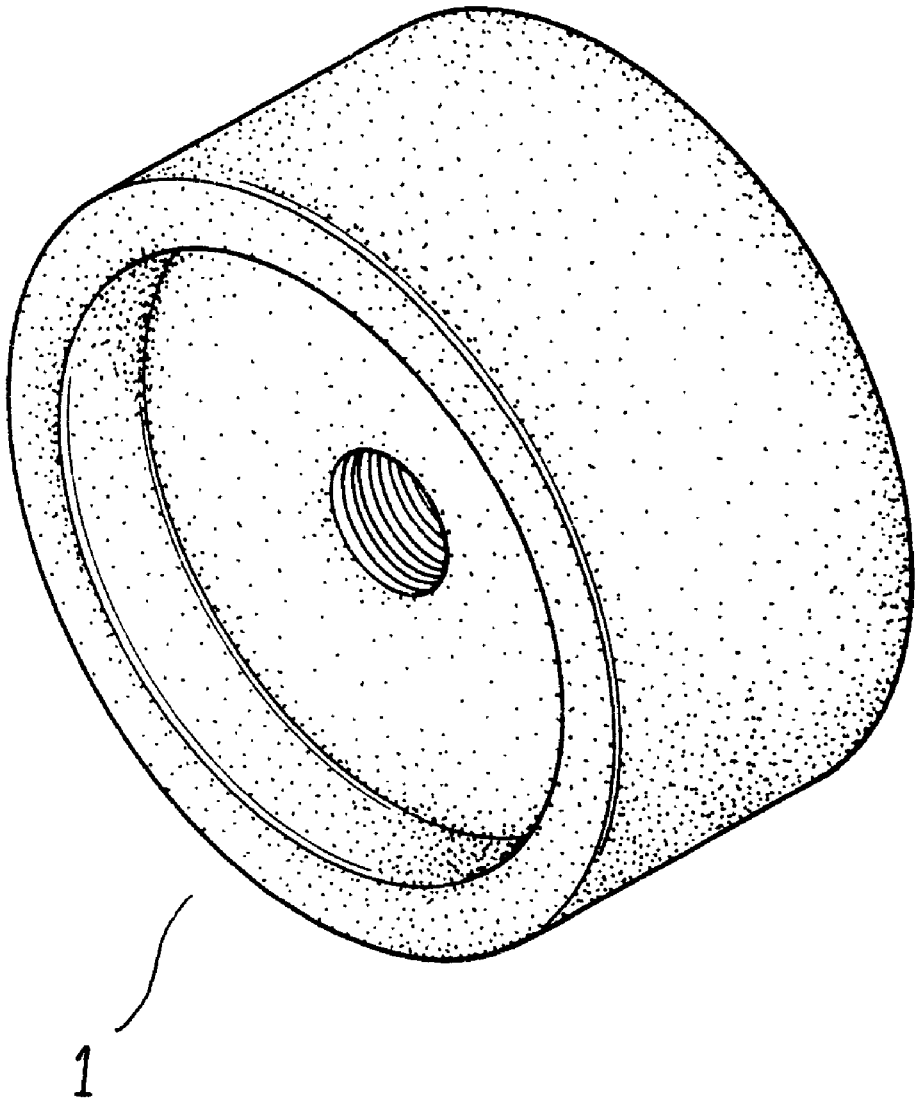
FIG. 1 PRIOR ART
FIG. 1 is a perspective view of a conventional roller skate wheel according to the prior art.
Figure 2:
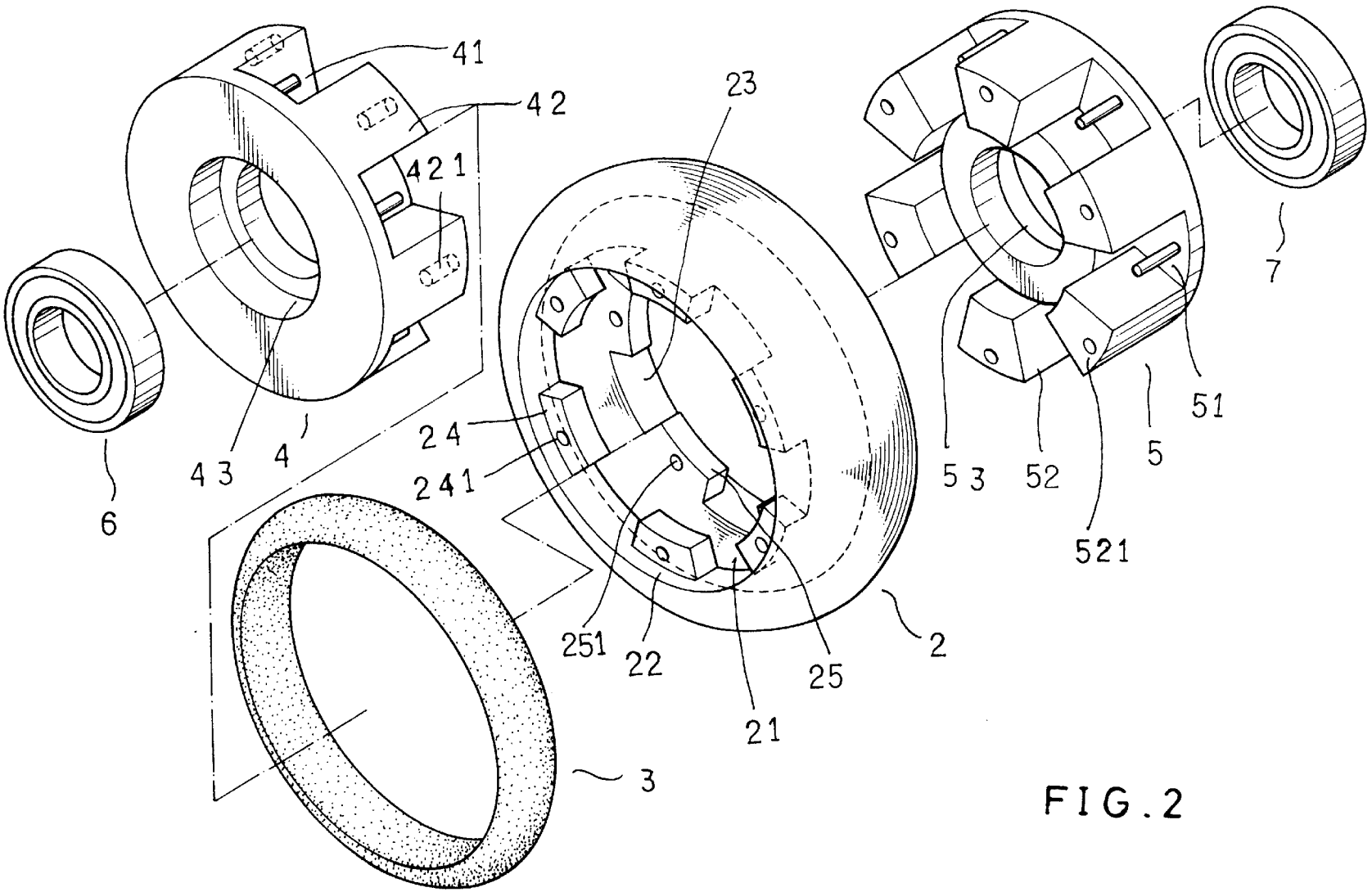
FIG. 2 is an exploded view of a roller skate wheel according to the present invention.
Figure 3:
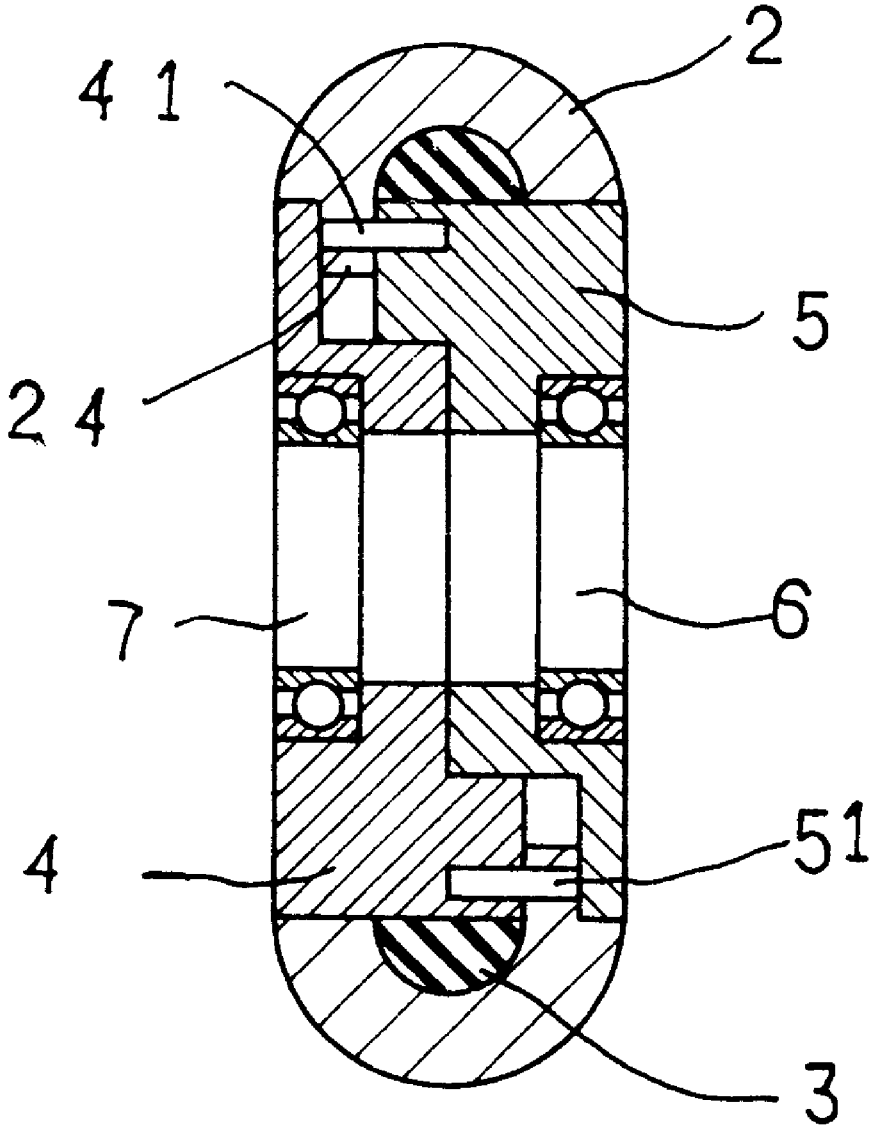
FIG. 3 is a front plan cross-sectional assembly view of the roller skate wheel as shown in FIG. 2.

With reference to FIGS. 2–5, a roller skate wheel according to the present invention comprises an outer wheel body 2 defining a receiving space 21 and having an inner wall formed with a first annular flange 22 and a second annular flange 23 spaced from each other, an inner tire 3 received in the receiving space 21, a first wheel cap 4 secured to the first annular flange 22 and defining a first opening 43 therein, a first bearing 6 received in the first opening 43 of the first wheel cap 4, a second wheel cap 5 secured to the second annular flange 23 and securely coupled with the first wheel cap 4, and defining a second opening 53 therein, and a second bearing 7 received in the second opening 53 of the second wheel cap 5.

The first annular flange 22 is formed with a plurality of first blocks 24 spaced from each other and each defining a first hole 241, and the first wheel cap 4 is formed with a plurality of first lugs 42 spaced from each other and each located between the two adjacent first blocks 24 of the first annular flange 22, and a plurality of first positioning posts 41 each formed between the two adjacent first lugs 42 and each extending through the first hole 241 of one of the corresponding first blocks 24.

The second annular flange 23 is formed with a plurality of second blocks 25 spaced from each other and each defining a second hole 251, and the second wheel cap 5 is formed with a plurality of second lugs 52 spaced from each other and each located between the two adjacent second blocks 25 of the second annular flange 23, and a plurality of second positioning posts 51 each formed between the two adjacent second lugs 52 and each extending through the second hole 251 of one of the corresponding second blocks 25.

Each of the first lugs 42 is located between the two adjacent second lugs 52 and defines a first recess 421 to receive the respective second positioning post 51 therein, and each of the second lugs 52 is located between the two adjacent first lugs 42 and defines a second recess 521 to receive the respective first positioning post 41 therein.

Figure 4:
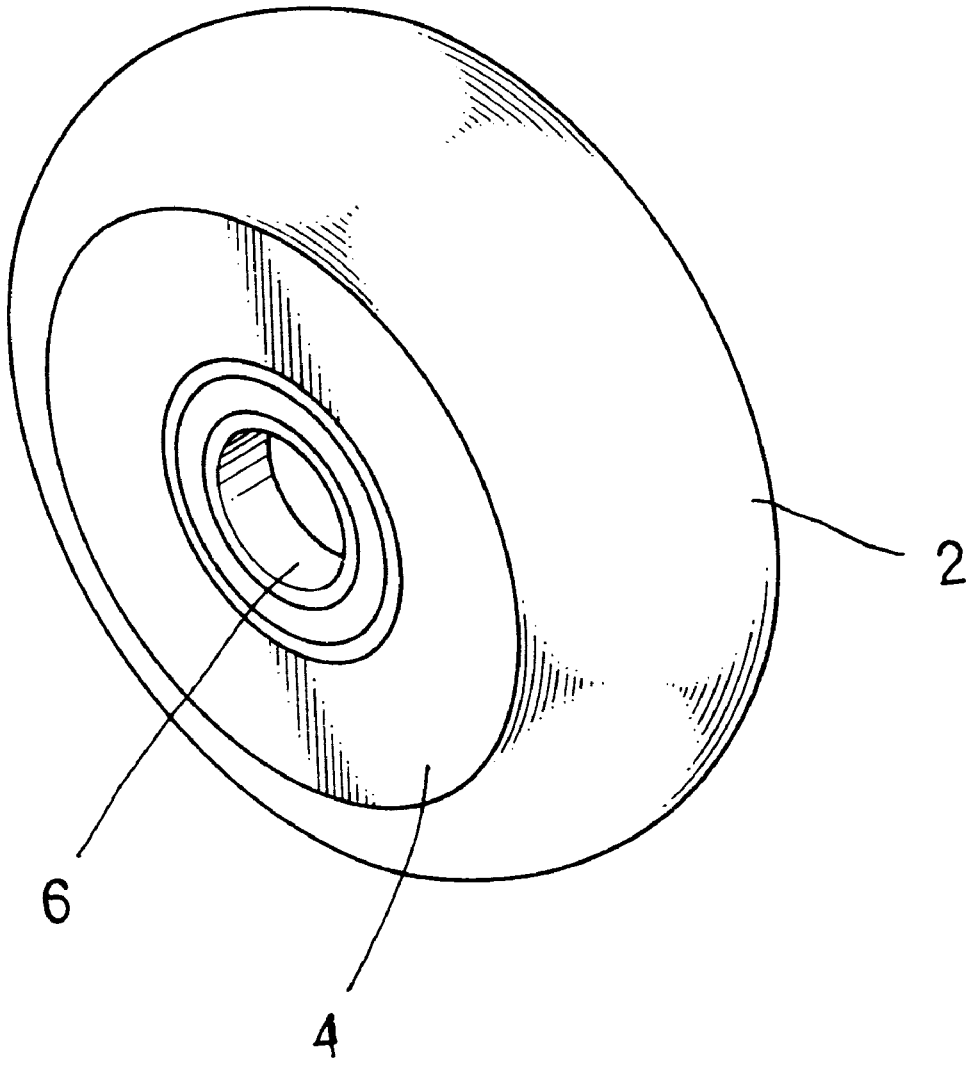
FIG. 4 is a perspective assembly view of the roller skate wheel as shown in FIG. 2.
Figure 5:
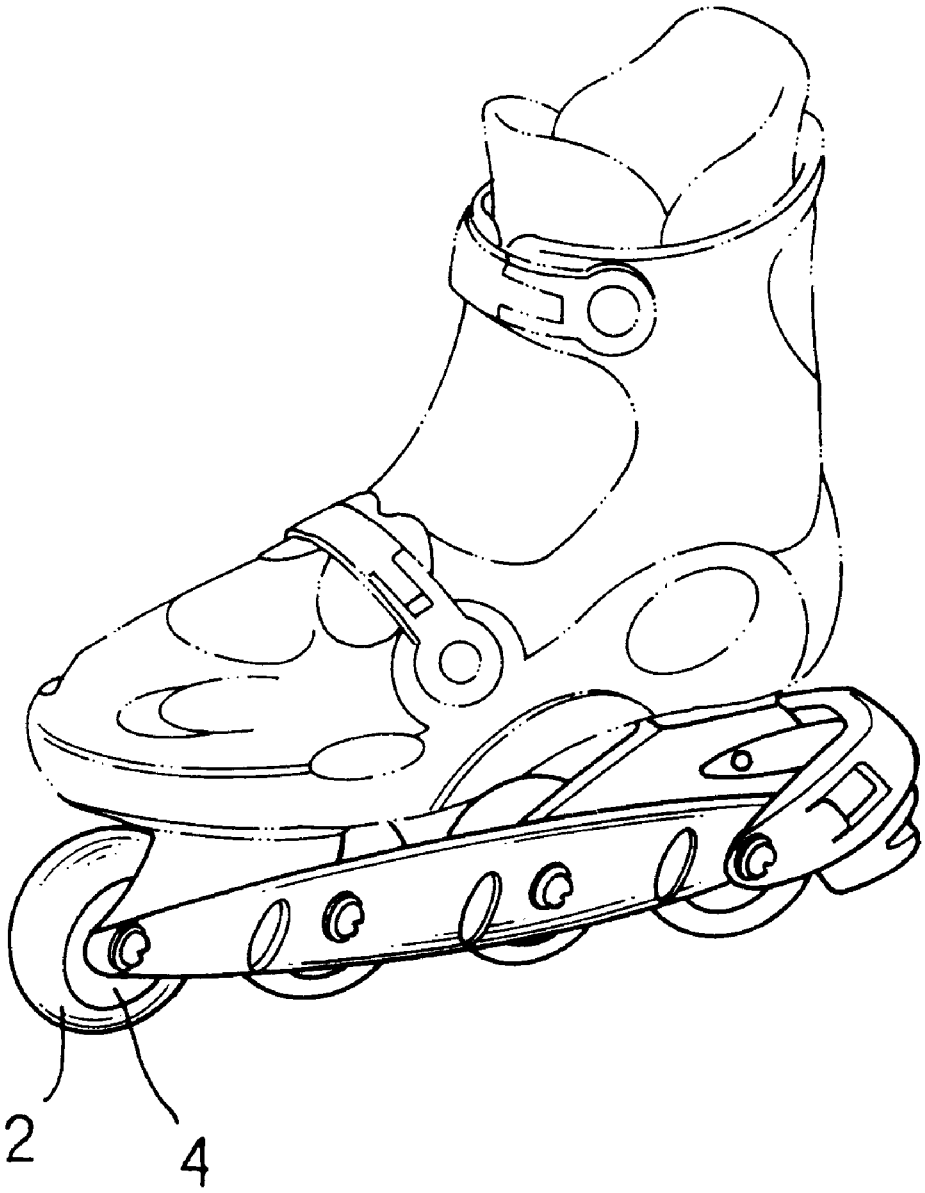
FIG. 5 is a perspective view of a roller skate according to the present invention.

In assembly, the inner tire 3 is received into the receiving space 21, the first wheel cap 4 and the second wheel cap 5 are then respectively inserted into the outer wheel body 2 to couple with each other, and the first bearing 6 and the second bearing 7 are then inserted into the first wheel cap 4 and the second wheel cap 5, thereby assembling the roller skate wheel as shown in FIG. 4.

Accordingly, the inner tire 3 made of an elastomer material can be used to absorb an external impact so as to increase the resilience of the outer wheel body 2. In such a manner, the outer wheel body 2, in addition to its essential elasticity, can properly introduce the external force to be absorbed by the inner tire 3, so as to decrease the strength of impact exerted on the outer wheel body 2, thereby preventing injuring the exerciser during exercising. In addition, the roller skate wheel is made light, thereby greatly decreasing the weight of the roller skate. Further, the roller skate wheel has a simple construction, and is easily assembled and dismantled.

Figure 6:
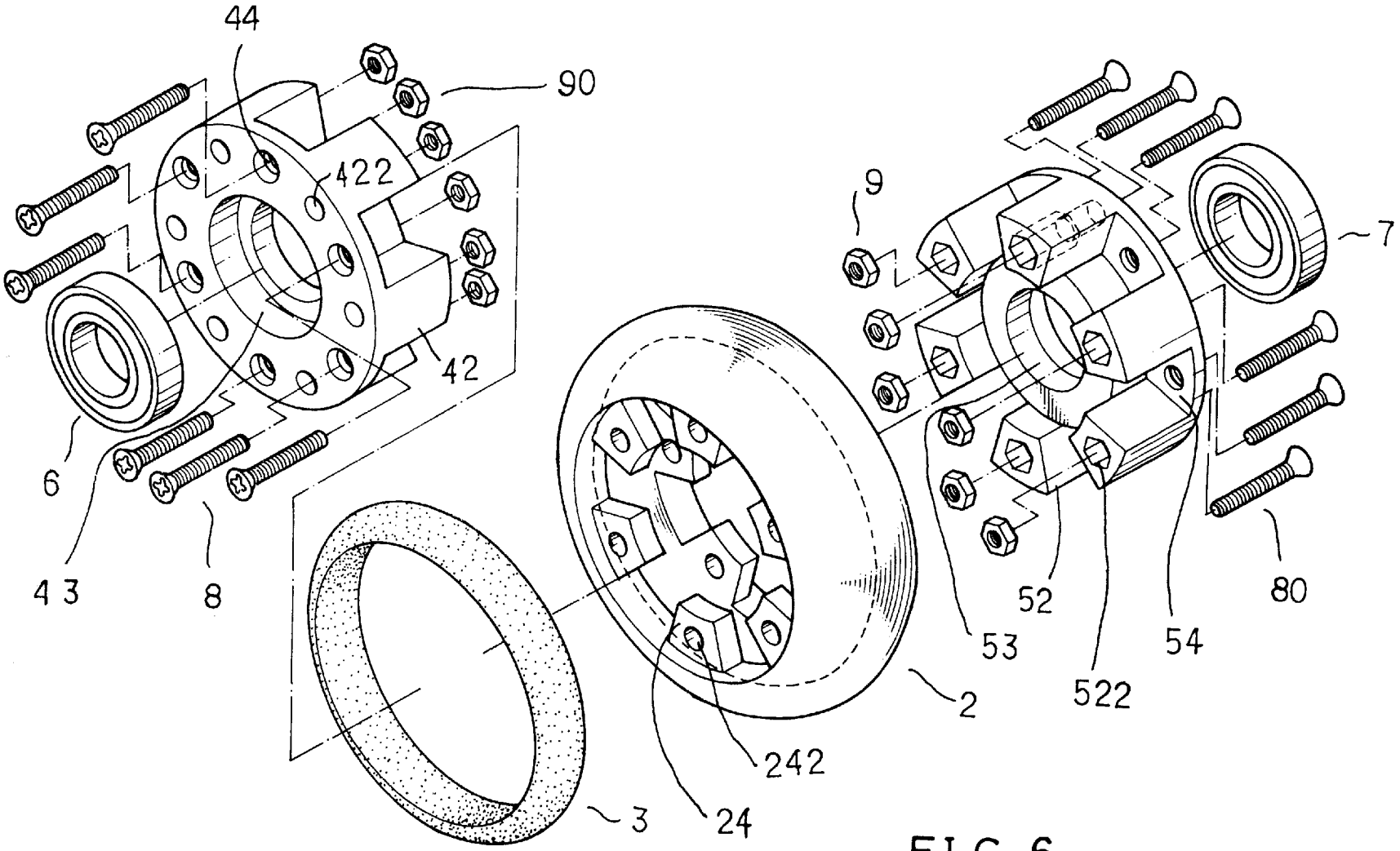
FIG. 6 is an exploded view of a roller skate wheel according to another embodiment of the present invention.
Figure 7:
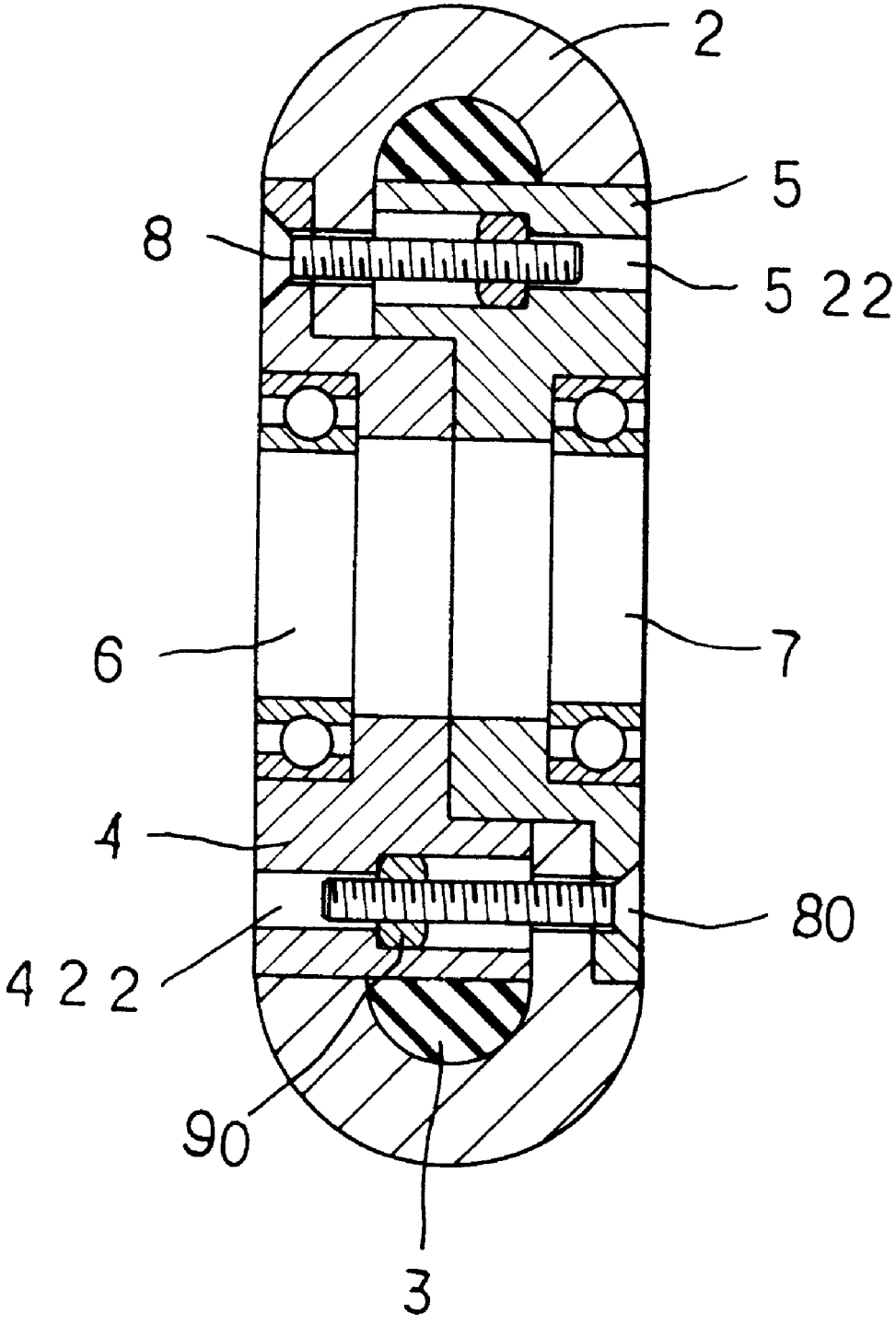
FIG. 7 is a front plan cross-sectional assembly view of the roller skate wheel as shown in FIG. 6.

With reference to FIGS. 6 and 7, according to another embodiment of the present invention, the first annular flange 22 is formed with a plurality of first blocks 24 spaced from each other and each defining a first hole 242, the second annular flange 23 is formed with a plurality of second blocks 25 spaced from each other and each defining a second hole 252, the first wheel cap 4 is formed with a plurality of first lugs 42 spaced from each other each located between the two adjacent first blocks 24 of the first annular flange 22, and each defining a first receiving passage 422, a plurality of first threaded holes 44 defined in the first wheel cap 4 and each located between the two adjacent first lugs 42, the second wheel cap 5 is formed with a plurality of second lugs 52 spaced from each other each located between the two adjacent second blocks 25 of the second annular flange 23, and each defining a second receiving passage 522, a plurality of second threaded holes 54 defined in the second wheel cap 5 and each located between the two adjacent second lugs 52, a plurality of first nuts 9 each received in the second receiving passage 522 of one of the corresponding second lugs 52, a plurality of second nuts 90 each received in the first receiving passage 422 of one of the corresponding first lugs 42, a plurality of first bolts 8 each extending through one of the corresponding first threaded holes 44 and each engaged with one of the corresponding first nuts 9, and a plurality of second bolts 80 each extending through one of the corresponding second threaded holes 54 and each engaged with one of the corresponding second nuts 90.

Although the present invention has been described with a certain degree of particularity, it is to be understood that the present disclose has been made by way of example only and that many other possible modifications and variations can be made without departing from the scope of the present invention.

I claim:

1. A roller skate wheel comprising:

an outer wheel body defining a receiving space and having an inner wall formed with a first annular flange and a second annular flange spaced from each other, said first annular flange being formed with a plurality of first blocks spaced apart from one another and each defining a first hole;

an inner tire received in said receiving space;

a first wheel cap secured to said first annular flange, said first wheel cap being formed with a plurality of first lugs spaced apart from one another, each said first lug extending between adjacent ones of said first blocks of said first annular flange, said first wheel cap having a plurality of first positioning posts each disposed between adjacent ones of said first lugs, each of said first positioning posts extending into said first hole of one of said corresponding first blocks; and a second wheel cap secured to said second annular flange and securely coupled to said first wheel cap.

2. The roller skate wheel as recited in claim 1, wherein said second annular flange is formed with a plurality of second blocks spaced from each other and each defining a second hole, and said second wheel cap is formed with a plurality of second lugs spaced from each other and each located between adjacent ones of said second blocks of said second annular flange, and a plurality of second positioning posts each formed between adjacent ones of said second lugs and each extending through said second hole of one of said second blocks.

3. The roller skate wheel as claimed in claim 2, wherein each of the first lugs is located between the two adjacent second lugs and defines a first recess to receive the respective second positioning post therein, and each of the second lugs is located between the two adjacent first lugs and defines a second recess to receive the respective first positioning post therein.

4. The roller skate wheel as claimed in claim 1, wherein the first wheel cap defines a first opening therein, and the roller skate wheel further comprises a first bearing received in the first opening.

5. The roller skate wheel as claimed in claim 1, wherein the second wheel cap defines a second opening therein, and the roller skate wheel further comprises a second bearing received in the second opening.

6. A roller skate wheel comprising:

an outer wheel body defining a receiving space and having an inner wall formed with a first annular flange and a second annular flange spaced from each other;

an inner tire received in said receiving space;

a first wheel cap secured to said first annular flange; and, a second wheel gap secured to said second annular flange and securely coupled to said first wheel cap said first annular flange being formed with a plurality of first blocks spaced from each other and each defining a first hole, said second annular flange being formed with a plurality of second blocks spaced from each other and each defining a second hole, said first wheel cap being formed with a plurality of first lugs spaced from each other each located between adjacent ones of said first blocks of said first annular flange, and each defining a first receiving passage, a plurality of first threaded holes being defined in said first wheel cap and each located between adjacent ones of said first lugs, said second wheel cap being formed with a plurality of second lugs spaced from each other each located between adjacent ones of said second blocks of said second annular flange, and each defining a second receiving passage, a plurality of second threaded holes being defined in said second wheel cap and each located between adjacent ones of said second lugs, a plurality of first nuts each received in said second receiving passage of a corresponding one of said second lugs, a plurality of second nuts each received in said first receiving passage of a corresponding one of said first lugs, a plurality of first bolts each extending through a corresponding one of said first threaded holes and each engaged with a corresponding one of said first nuts, and a plurality of second bolts each extending through a corresponding one of said second threaded holes and each engaged with a corresponding one of said second nuts.

* * * * *